US005989066A

United States Patent [19]

Cox

[11] Patent Number: 5,989,066

[45] Date of Patent: Nov. 23, 1999

[54] ELECTRICAL CONNECTOR WITH DUAL POSITION LATCHED TERMINAL POSITION ASSURANCE

[75] Inventor: Brian Douglas Cox, Winston-Salem, N.C.

[73] Assignee: The Whitaker Corporation, Wilmington, Del.

[21] Appl. No.: 08/993,162

[22] Filed: Dec. 18, 1997

[51] Int. Cl.[6] ..... H01R 13/40

[52] U.S. Cl. ..... 439/595; 439/752

[58] Field of Search ..... 439/362–364, 439/594–598, 752

[56] References Cited

U.S. PATENT DOCUMENTS

| | | | |
|---|---|---|---|
| 4,557,542 | 12/1985 | Coller et al. . | |
| 5,071,369 | 12/1991 | Denlinger et al. | 439/595 |
| 5,181,862 | 1/1993 | Hawk et al. | 439/595 |

*Primary Examiner*—Khiem Nguyen

[57] ABSTRACT

An electrical connector 2 includes terminal 4 in a housing 10 with a terminal position assurance member 30 backing up the resilient latches 18 holding the terminals 4 in housing cavities 16. The terminal position assurance member 30, inserted through the housing mating face 12, is shiftable between a partially inserted position, in which terminals 4 can be inserted into cavities 16 through the housing rear face 14 and a locked position after all terminals 4 have been properly inserted. The terminal position assurance member 30 includes a horizontal wall 36 insertable behind the housing latches 18 and panels 42 on either side. To shift the terminal position assurance member 30 to the locked position, the panel must deflect outwardly about a fixed front edge 46 and a fixed base edge 44 to permit an inwardly extending panel latching projection 50 to pass a housing shoulder 26. To prevent plastic deformation of the latching projection 50, the latching projection upper surface 52 is inclined and its height, measured relative to the panel 42 increases with distance away from the horizontal wall 36.

20 Claims, 3 Drawing Sheets

ELECTRICAL CONNECTOR WITH DUAL POSITION LATCHED TERMINAL POSITION ASSURANCE

BACKGROUND OF THE INVENTION

1. Field of the Invention

This invention relates to electrical connectors having terminal position or secondary locking members for insuring that all of the connector terminals are properly positioned in the electrical connector housing.

2. Description of the Prior Art

Terminal position assurance members are commonly used in electrical connectors that are used in the automotive industry. Improperly assembled electrical connectors pose a problem in any application in which electrical connectors must be assembled on wiring harnesses. If one terminal is not properly positioned, the entire harness can be defective and considerable time and effort may be necessary to diagnose this problem.

When a large number of connectors must be assembled and installed it becomes impractical to rely upon an operator to reliably install all of the terminals or to inspect to determine if automatic assembly equipment has properly loaded all of the connectors.

One approach that is commonly used in the automotive industry to counteract this problem is the use of terminal position assurance members that cannot be properly installed in a connector if any of the terminals in that connector are only partially inserted. These terminal position assurance members are commonly used with connector housings which have resilient latches that are integral parts of the molded plastic connector housing and extend into housing cavities to engage terminals inserted in the connector. One common approach is to employ a connector housing in which the terminals are inserted into housing cavities through a rear housing face after wires have been attached or crimped to the terminals. As the terminals are inserted further into the housing cavities, the terminal progressively deflect the housing terminal latches until the terminals pass the latches and the latches return to their normal position where they engage the terminals to prevent extraction of the terminals through the housing rear face. After the terminals are latched in this manner, a terminal position assurance member is inserted through the mating face of the connector housing. A ledge, shelf or wall on the terminal position assurance member then slides behind the latches to hold the latches in engagement with the terminals. However, if any one terminal is only partially inserted, the terminal position assurance will engage a deflected housing terminal latch and cannot be fully inserted. Incomplete insertion of the terminal position assurance member can then be used to detect an improperly assembled or loaded connector. One reason for inserting these terminal position assurance members through the front or mating face of the connector is that a partially inserted terminal position assurance member should prevent mating of the improperly assembled connector with a mating connector.

Electrical connector housing assemblies are commonly shipped with a terminal position assurance member latched to the connector housing in a partially assembled configuration in which the terminal latches are free to deflect during terminal insertion. Since the terminals are normally attached to wiring harnesses at a harness assembly location and not at a molding location, shipping in a partially assembled configuration is a common practice. However, it is important that the terminal position assurance member be latched in this partially inserted condition so that it cannot be extracted or fully inserted unless a minimum force, that is not typically encountered during shipping, is applied to the terminal position assurance member. Therefore the terminal position assurance members can include latching projections that hold the terminal position assurance members in the partially inserted and in a locked position. To shift the terminal position assurance member from the partially inserted to the locked position, that portion of the terminal position assurance member containing the latching projection must be flexible so that it can deflect to permit the latching projection to pass a latching shoulder on the housing. To allow for adequate deflection, the terminal position assurance members are normally molded from a non glass filled plastic that is flexible. However, care must be taken to prevent plastic deformation as the latching projection passes a harder, typically glass filled housing.

In one prior art connector the latching projections extend inwardly from vertical panels on the terminal position assurance member. The panels deflect outwardly, but to insure that a minimum force is applied before deflecting the panel so that the terminal position assurance member can be shifted to the locked position, this prior art connector employs a panel that if fixed along perpendicular lower and front edges so that the panel cannot shift as a conventional cantilever beam, fixed at only one edge. In this configuration the latching projections can be smeared or plastically deformed and the latching projections then cannot properly engage the housing to hold the terminal position assurance member in the latched configuration.

SUMMARY OF THE INVENTION

The instant invention comprises an electrical connector that includes a terminal position assurance member that is shiftable from a partially assembled or shipping configuration to a locked position after terminals have been properly inserted into the connector housing. The terminal position assurance member includes a horizontal wall, ledge, tongue, or shelf with vertically extending panels extending from the horizontal wall. Latching projections extend inwardly from the panels and the panels must be deflected outwardly to permit the latching projections to pass a housing shoulder during movement from the partially assembled to the fully assembled position. These panels are joined to the terminal position assurance member along a base edge and a front edge so that the sufficient force needed in order to shift from the partially inserted to the locked position is achieved. To insure that the latching projection is not excessively plastically deformed the top surface is inclined relative to the panel and to the horizontal wall. The height of the latching projection upper surface, as measured from the corresponding panel, increases with distance from the horizontal wall. This prevents high stress, or force per unit area, from plastically deforming the latching projection upper surface because a larger surface area engages the housing as the latching projection is shifted from its partially inserted to its fully inserted position. Plastic deformation of the latching projection can therefore be reduced without requiring substitution of another plastic or without resorting to complicated molding configurations. Minimum, required insertion forces can therefore be achieved, and the elimination of plastic deformation of the latching projection provides a more reliable latch holding the terminal position assurance member in the locked position.

DETAILED DESCRIPTION OF THE PREFERRED EMBODIMENT

Figure 1:
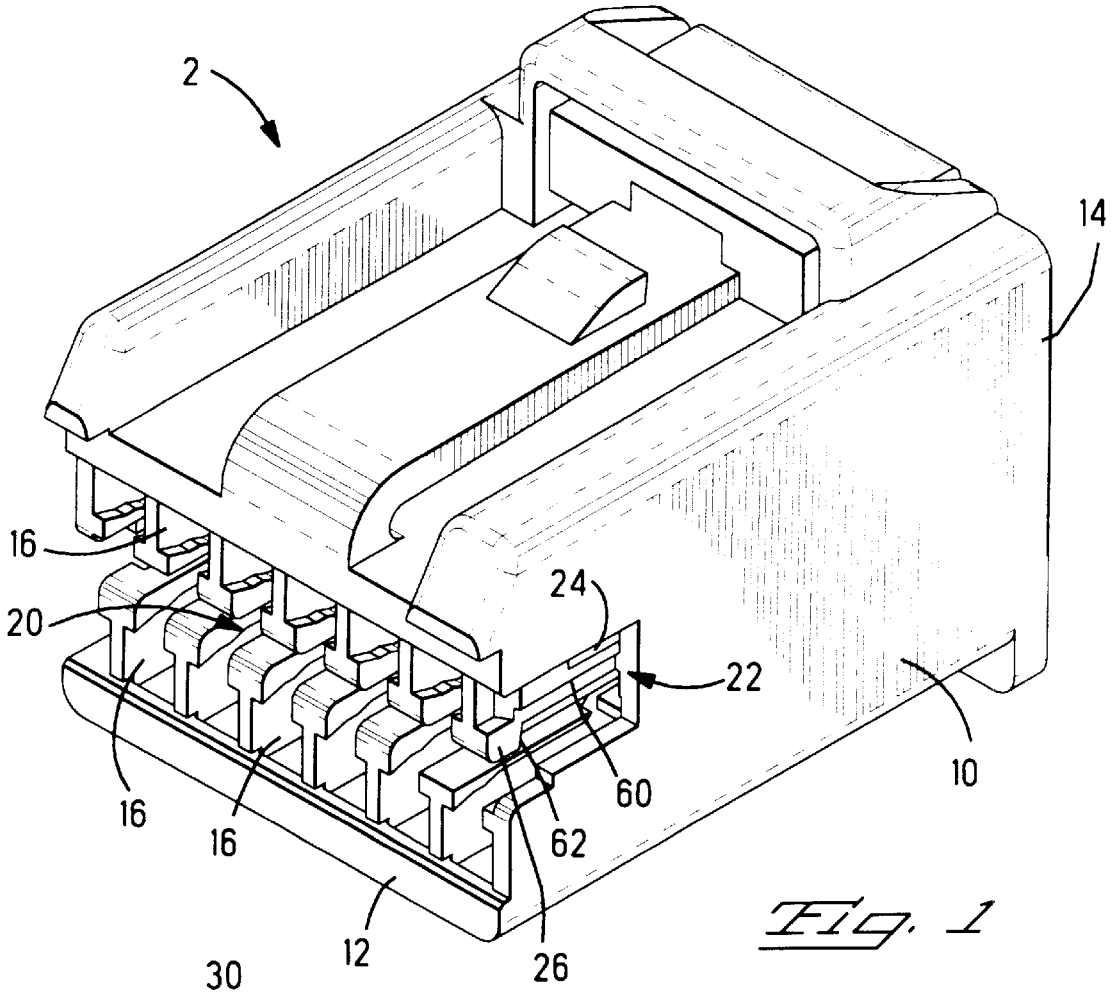
FIG. 1 is a view of the electrical connector housing showing the mating face.
Figure 6:
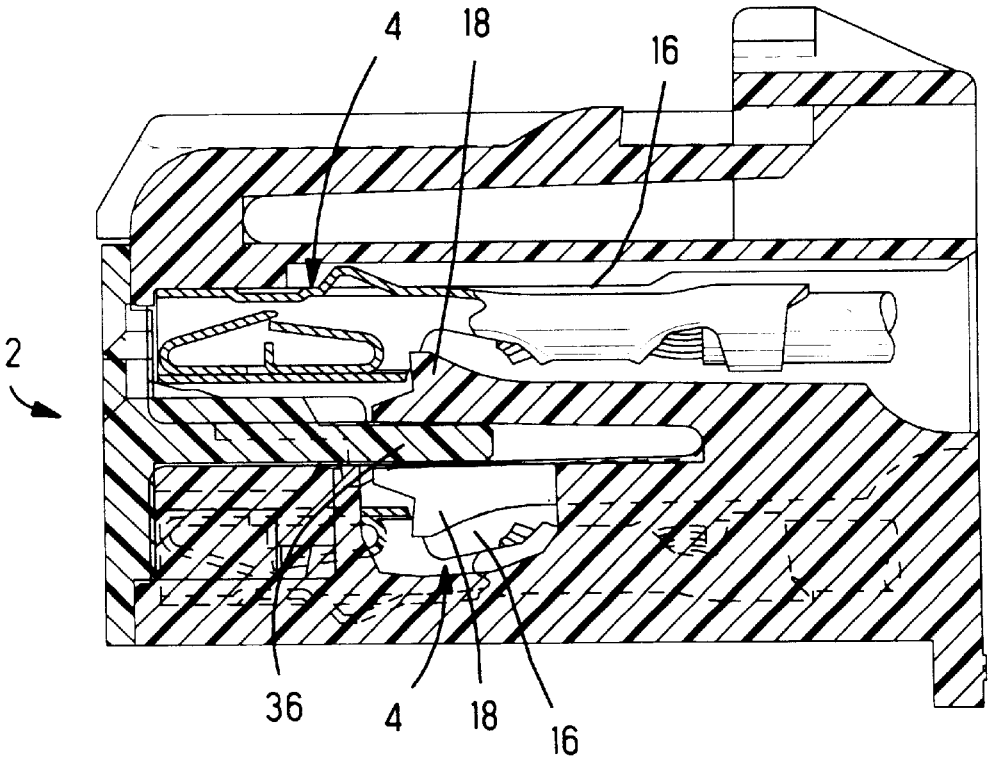
FIG. 6 is a side view showing the terminal position assurance member preventing a housing latch from being disengaged from a terminal fully inserted into a corresponding housing cavity.

The preferred embodiment of this invention is a twelve position electrical connector 2 that is typically used to connect wires connected to terminals 4 in the electrical connector to a male connector, such as a pin header that would be mounted on a printed circuit board. The connector housing 10 is shown in FIG. 1, and the manner in which the terminals 4 are mounted in the housing 10 is illustrated in FIG. 6. When all of the terminals 4 are properly inserted into corresponding cavities 16 the housing 10, a terminal position assurance (TPA) member 30 can be inserted through the mating face 12 of the connector housing 10 into a locked position behind a resilient terminal latch 18 securing the terminals 4 in the cavities 16. If any terminal 4 is not fully inserted into its corresponding cavity 16, the terminal latch 18 will be deflected, and upon insertion the TPA member 30 will abut the end of the terminal latch 18 preventing full insertion of the TPA member 30.

Figure 3:
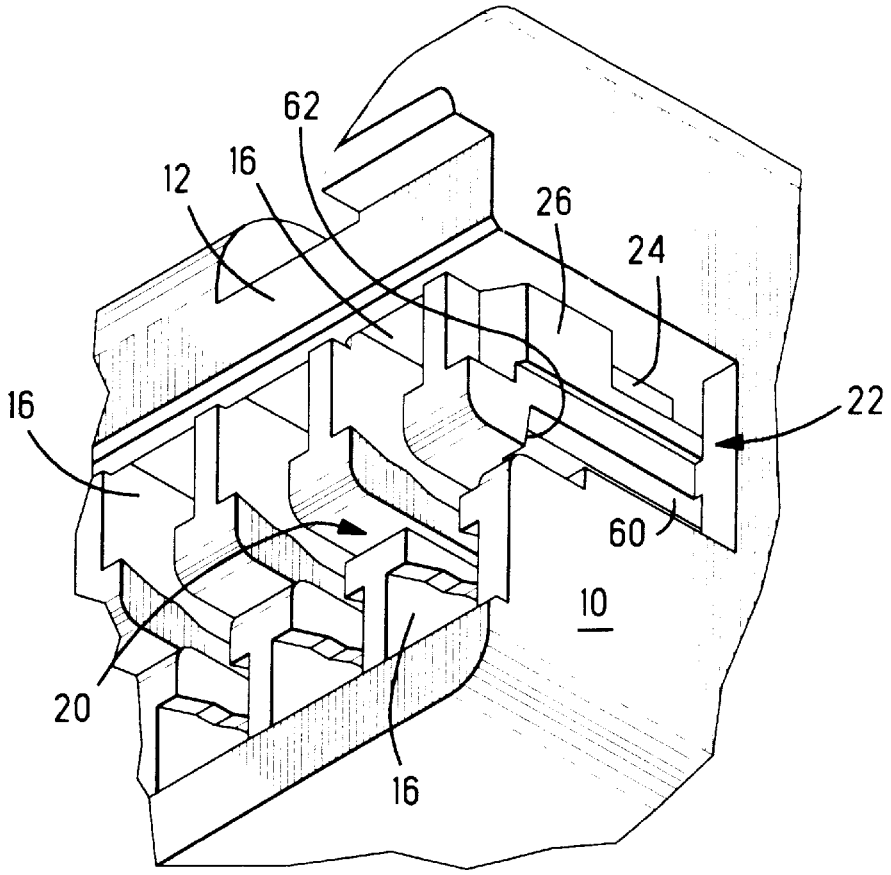
FIG. 3 is an enlarged view of the mating face of the electrical connector housing showing the terminal cavities, the terminal position assurance member slot and a panel slot on the end of the housing.

The connector housing 10, as shown in FIG. 1, includes cavities 16 extending between a front or mating face 12 and a rear face 14. Terminals 4 are inserted into the housing cavities 16 through the rear housing face 14, and the TPA member 30 can be inserted into a TPA slot 20 which opens onto the mating housing face 12. The connector housing also includes a TPA panel receiving slot 22 on each end of the housing mating face 12. This TPA panel receiving slot 22 is generally rectangular in shape and communicates with the TPA slot 20. Details of the housing mating face 12 in the vicinity of the TPA panel receiving slot 22 are shown in FIG. 3. The housing includes two grooves extending parallel to the terminal cavities 16. The first groove 60 is located adjacent to the TPA slot 20 and extends from an inner shoulder 62 on the housing mating face. A second groove 24 is located adjacent to the top of the TPA panel receiving slot 22. An outer shoulder 26 adjacent to the top of the TPA panel slot 22, as viewed in FIG. 3, is also located adjacent the mating face 12. The inner groove 60 extends closer to the mating face 12 than the outer groove 24. These grooves 60 and 24 receive locking projections or tabs on the TPA member 30 to hold the TPA in either a partially inserted position or in a locked position in a manner to be subsequently discussed.

Figure 2:
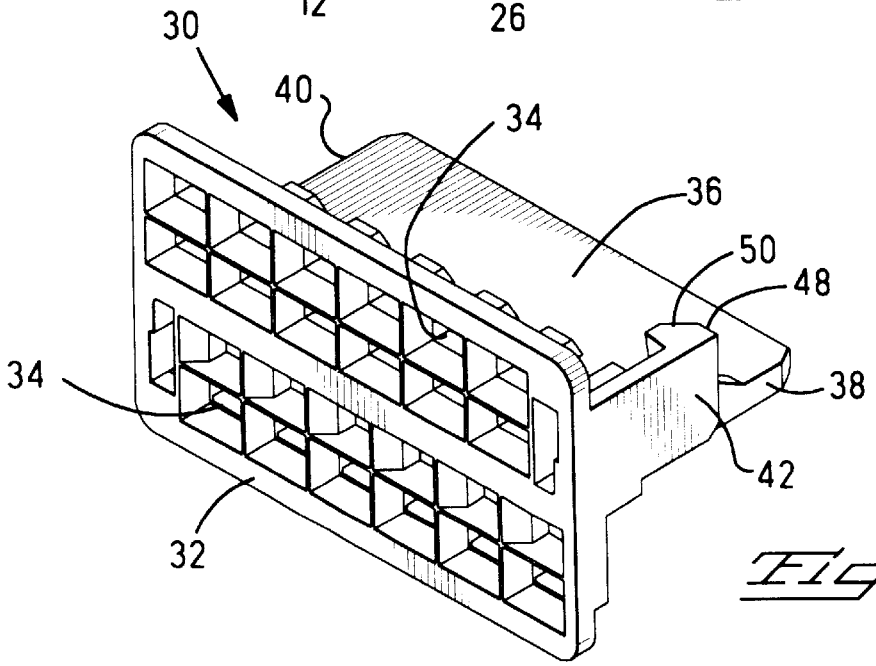
FIG. 2 is a view of a terminal position assurance member that is insertable into the electrical connector housing through the front mating face.
Figure 4:
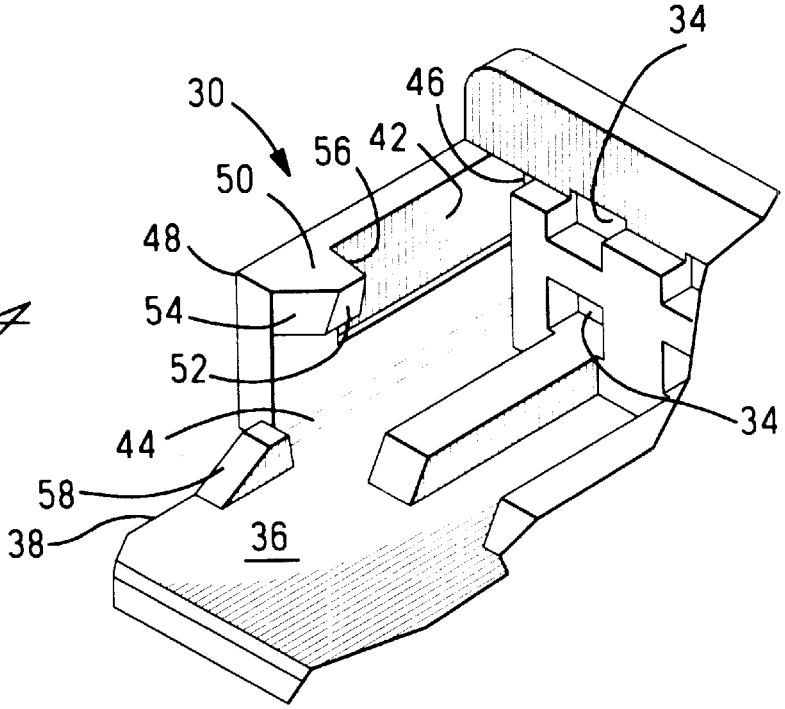
FIG. 4 is an enlarged view of one end of the terminal position assurance member showing the latching projection.
Figure 5:
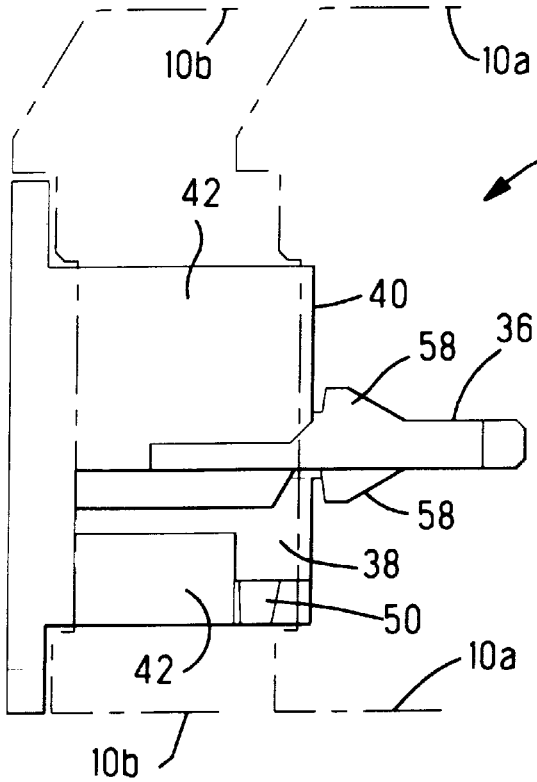
FIG. 5 is a side view of the terminal position assurance member showing a panel at opposite ends, and showing the relative position of the terminal position assurance member and the housing when the terminal position assurance member is in the partially inserted position and in the locked position.

The terminal position assurance member or TPA 30 is shown in FIG. 2, and FIG. 4 is an enlarged view showing more details of the TPA 30. FIG. 5 is a side view of the TPA 30 showing TPA panels 42 extending in opposite directions on opposite ends of the TPA 30. The terminal position assurance member 30 has a TPA front face 32 which has pin openings 34 which are aligned with the housing cavities 16 when the TPA 30 is mounted on the housing 10. The TPA front face 32 also includes additional openings adjacent to the pin openings 34 to provide access to the interior of the housing for probing terminals 4 with a continuity checker.

The TPA 30 has a horizontal wall, ledge or tongue 36 that is dimension to be received with the TPA slot 20 in the housing 10. It is this TPA horizontal wall 36 that fits behind a properly positioned terminal latch 18 when the terminals 4 are properly inserted as shown in FIG. 6. Horizontal wall 36 extends rearwardly from the center of the TPA front face 32. The horizontal wall 36 extends substantially the entire width of the TPA 30 between a first end 38 and a second end 40.

TPA 30 also has vertically extending panels 42 extending upwardly from the horizontal wall 36 on the first end 38 and extending downwardly from the second end 40. These panels 42 can be identical or they can have different sizes to key the TPA 30 relative to the housing 10. Each panel 42 is joined or integral with the rear of the TPA front face 32 along a vertically extending front edge 46. The panels 42 are also joined to or integral with the horizontal wall 36 along a base edge 44. A top edge and a rear edge leading to an upper rear corner 48 are free or unsupported so that the panels 42 can deflect outwardly relative to the fixed edges 44 and 46. In other words the generally rectangular panels 42 can be deflected relative to two perpendicular adjoining generally fixed edges 44 and 46. Thus the panels 42 do not constitute traditional cantilever beams that are supported along only one fixed edge. Therefore greater force is required to deflect the panels 42 than would be required if the panels 42 were fixed along only one edge.

A latching projection 50 extends inwardly from the vicinity of the upper rear panel corner 48 as shown in FIG. 4. This projection has an inclined leading edge 54 located adjacent to the rear edge of the panel 42. A trailing edge 56 on the opposite side of the latching projection 50 extends substantially perpendicular to the plane of the panel 42. The top surface 52 of latching projection 50 is also inclined relative to the panel 42 and to the horizontal wall 36. The height of the latching projection 50, when measured from the panel 42 increases with distance from the horizontal wall 36. As shown in FIG. 4, the inclination of the top surface 52 causes the height of the inclined leading edge 54 to be less at the edge facing the horizontal wall 36 than at the outer edge adjacent to the corner 48.

The TPA also includes a tab 58 extending upwardly from the horizontal wall 36. One of these tabs is located adjacent to each panel 42 and extends from the wall 36 in the same direction as the panel. The tabs 58 are closer to an exposed edge of the wall 36 than the latching projection 50, and the latching projection 50 is closer to the front TPA face 32. Tabs 58 also have an inclined leading edge facing the rear edge of wall 36 and a substantially perpendicular edge facing the TPA front face 32.

The latching projections 50 and the tabs 58 are dimensioned to be received respectively in grooves 24 and 60 and to respectively engage shoulders 26 and 62. The projections 50 and the tabs 58 cooperate to hold the TPA 30 in a partially extended position, in which terminals 4 can be inserted into engagement with terminal latches 18, and the locked position shown in FIG. 6 in which the resilient terminal latch 18 is held in its undeflected position by the horizontal wall 36.

The dashed lines in FIG. 5 generally show the partially inserted and the fully inserted positions. The dashed lines 10*a* show the relative position that would be occupied by the housing 10 when the TPA is in the partially inserted position. The dashed lines 10*b* shown the position of the housing 10 relative to the TPA 30 when the TPA is in the fully inserted or locked position.

The TPA 30 is positioned in the partially inserted position to permit the terminals 4 to be inserted into cavities 16. In the partially inserted position the horizontal wall 36 does not interfere with the deflection of the resilient terminal latches 18 during insertion of the terminals 4 into the cavities 16. The TPA 30 and the housing 10, both of which are injection molded, are shipped in this partially inserted position, because the terminals 4 can only be inserted after wires have been attached. It is important that the TPA 30 remain in this partially inserted position during shipping. If only a small portion of the TPA's, which are shipped in bulk, were to be inadvertently forced into the locked position or inadvertently removed, unacceptable manufacturing complications would arise. It is important that the connectors 2 be assembled to wiring harnesses inexpensively in large volumes. A few defective assemblies can cause serious problems. Therefore the TPA 30 must remain in the partially inserted position when subjected to minimum insertion or extraction forces during shipping. For the preferred embodiment of this invention, the TPA 30 must remain in the partially inserted position unless subjected to a extraction force greater than 25 newtons (N) or when subjected to an insertion force between 30 and 55 N.

The latching tabs 58 are provided to prevent inadvertent extraction of the TPA 30 when the TPA is in the partially inserted position. TPA 30 is inserted into the TPA slot 20 until the tabs 58 enter grooves 60 on the interior of the housing mating face 12. The perpendicular interior edge of tabs 58 engage the inner shoulders 62 to prevent extraction of the TPA 30 from the housing 10.

In this partially inserted position, the latching projection 50 engages the housing mating face shoulder 26 to keep the TPA from being inserted further into TPA slot 20 unless additional force is applied. The inclined leading edge 54 of latching projection 50 engages the front of shoulder 26. However, the latching projection 50 extends from panel 42 and therefore extends perpendicular to the tabs 58. When the TPA 30 is shifted to the locked position, the latching projection 50 must shift past the shoulder 26 at the end of groove 24. The latching projection leading edge 54 is inclined to deflect the latching projection 50 outwardly. The panel 42 deflects outwardly to permit movement of the latching projection 50 past the shoulder 26. However, in order to prevent movement of latching projection 50 past shoulder 26, a minimum insertion force of 30 N must be applied, the panel 42 is not a cantilever beam fixed only at the front edge 46. By affixing the base edge 44 of the panel 42 to the horizontal wall 36 from the front edge 46 past the latching projection 50 to the rear edge, additional force is necessary to outwardly deflect the panel 42. The latching projection 50 is spaced from both the front edge 46 and the base edge 44 at the upper rear corner 48 so that the panel flexes about both the front edge 46 and the base edge 44. To permit the panel 42 to flex, the TPA 30 is molded from a relatively flexible non glass filled plastic such as polybutylene terephthalate. However, to insure proper dimensional characteristics, the housing 10 is preferably molded from a glass filled PBT resin such as VALOX. VALOX is a trademark of General Electric Co. Since the TPA 30 and latching projection 50 are molded from a plastic with a greater tendency to deform that then the housing 10, the latching projection 50 can be smeared or plastically deformed as it passes the glass filled shoulder 26. This tendency toward plastic deformation is even greater when the stress applied to the latching projection 50 is concentrated over a relatively small area, such as a corner of the top surface of the latching projection. Therefore the upper surface 52 is inclined relative to the panel 42 and to the horizontal wall 36 with the height of the latching projection 50, measured relative to the panel 42, increases with distance away from the horizontal wall 36. Therefore the force applied to the top surface 52 is more evenly applied to a larger surface and the tendency to smear or plastically deform is less because the stress or force per unit area is less. After the latching projection 50 passes the shoulder 26, the latching projection enters the groove 24 and the perpendicular trailing edge 56 engages the shoulder 26 to prevent extraction of the latching projection 50 from the groove 24. If the latching projection 50 is plastically deformed, it is possible that the deformed latching projection 50 will not fit into the groove 24 and the TPA could be inadvertently removed. Furthermore, if the latching projection 50 does not fit within the groove 24, the panel 42 will not return to its normal position and will protrude beyond the sides of the housing 10 where is can be easily snagged or where in can prevent proper mating between the connector 2 and a mating shrouded pin header or other mating connector because the profile of the mating face will not correspond to the standard mating interface profile of the connector.

I claim:

1. An electrical connector comprising a plurality of terminals, a housing and a terminal position assurance member, the terminal position assurance member including a latching projection for releasably holding the terminal position assurance member in a first partially inserted position and when moved relative to the housing engaging the housing to hold the terminal position assurance member in a locked position, the latching projection extending inwardly from a panel, the panel being joined to the remainder of the terminal position assurance member along a base edge and a front edge, the latching projection being spaced from the base edge and the front edge, the panel being deflectable relative to the housing during movement between the partially inserted position and the locked position, the electrical connector being characterized in that the height of an upper surface of the latching projection, when measured from the panel, increases with increasing distance from the base edge so that the upper surface is inclined relative to the panel and the base edge so that as the panel deflects during movement from the partially inserted position to the locked position, plastic deformation of the latching projection is reduced and the latching projection provides greater security holding the terminal position assurance member in the locked position.

2. The electrical connector of claim 1 wherein the terminal position assurance member is formed from a plastic more subject to plastic deformation than the housing.

3. The electrical connector of claim 1 wherein the housing is formed from a plastic having a proportionally greater glass filled content than the terminal position assurance member.

4. The electrical connector of claim 1 wherein the terminal position assurance member is formed from a plastic having a greater flexibility than the housing.

5. The electrical connector of claim 1 wherein the base edge and the front edge of the panel are undeflected during movement of the terminal position assurance member from the partially inserted position to the locked position.

6. The electrical connector of claim 1 wherein the latching projection holds the terminal position assurance member in the partially inserted position when the housing and terminal position assurance member are shipped prior to insertion of the terminal into cavities in the housing.

7. The electrical connector of claim 6 wherein a minimum force of 30 newtons is required to deflect the panel to shift the terminal position assurance member from the partially inserted position to the locked position.

8. The electrical connector of claim 1 wherein the upper surface of the latching projection is parallel to the direction of movement of the terminal position assurance member during movement between the partially inserted and the locked positions.

9. The electrical connector of claim 1 wherein the housing includes a groove extending to a shoulder at a rear end of the housing, the latching projection being deflected by the shoulder during movement of the terminal position assurance member from the partially inserted to the fully inserted positions.

10. The electrical connector of claim 1 wherein the locking projection extends from an upper, rear corner of the panel.

11. The electrical connector of claim 1 wherein the terminal position member includes a horizontal wall, the panel being joined to the horizontal wall along the base edge of the panel member.

12. The electrical connector of claim 11 wherein panel members are located at opposite edges of the horizontal wall, each panel member including an inwardly extending latching projection.

13. The electrical connector of claim 11 wherein a tab on the horizontal wall engages the housing to retain the terminal position assurance member on the housing in the partially inserted position.

14. The electrical connector of claim 11 wherein panels are located on opposite ends of the horizontal wall and are located on the exterior of the housing when the terminal position assurance member is in the locked position.

15. An electrical connector comprising a plurality of terminals, a housing and a terminal position assurance member;

the housing including a mating face and a rear face with cavities extending between the mating face and the rear face, individual terminals being insertable into individual cavities through the rear face, the housing including a resilient latch in each cavity to secure the terminals in corresponding cavities;

the terminal position assurance member being insertable into the housing through the front face, the terminal position assurance member including a horizontal wall extending into the housing from the mating face to a position adjacent to the latches when the latches are positioned to secure the terminals in corresponding cavities, the horizontal wall abutting latches, and being only partially insertable into the housing, when a latch is held in a deflected position by a partially inserted terminal;

a vertically extending panel on at least one end of the terminal position assurance member, the vertically extending panel being joined to the horizontal wall along a base edge of the panel and being joined to the terminal position assurance member along a forward vertically extending edge;

a latching projection extending inwardly from the panel at a location spaced from the horizontal wall and the forward vertically extending edge, the latching projection engaging the housing when the terminal position assurance member is fully inserted into the housing;

the connector being characterized in that the height of an upper surface of the latching projection, when measured from the panel, increases with increasing distance from the horizontal wall so that the upper surface is inclined relative to the panel and the wall so that as the panel deflects during insertion into the housing, plastic deformation of the latching projection is reduced.

16. The electrical connector of claim 15 wherein the terminal position assurance member is formed from a plastic more subject to plastic deformation than the housing.

17. The electrical connector of claim 15 wherein the housing is formed from a plastic having a proportionally greater glass filled content than the terminal position assurance member.

18. The electrical connector of claim 15 wherein the terminal position assurance member is formed from a plastic having a greater flexibility than the housing.

19. The electrical connector of claim 15 wherein the base edge and the front edge of the panel are undeflected during movement of the terminal position assurance member from the partially inserted position to the locked position.

20. The electrical connector of claim 15 wherein a leading edge of the latching projection engages the housing to hold the terminal position assurance member in a partially inserted position and a trailing edge engages the housing to hold the terminal position assurance member in a locked position after a minimum force has been applied to the terminal position assurance member to shift the terminal position assurance member from the partially inserted position to the locked position.

* * * * *